US006435753B1

(12) United States Patent
Gusack

(10) Patent No.: US 6,435,753 B1
(45) Date of Patent: Aug. 20, 2002

(54) UNIVERSAL FLEXIBLE BINDER

(76) Inventor: Mark David Gusack, 9800 NW. 47 Dr., Coral Springs, FL (US) 33076-2602

( * ) Notice: Subject to any disclaimer, the term of this patent is extended or adjusted under 35 U.S.C. 154(b) by 0 days.

(21) Appl. No.: 09/583,226

(22) Filed: May 30, 2000

Related U.S. Application Data

(60) Provisional application No. 60/142,468, filed on Jul. 6, 1999.

(51) Int. Cl.[7] ..... B42F 13/00

(52) U.S. Cl. ..... 402/73; 24/67 R; 281/33; 402/75; 402/80 R

(58) Field of Search ..... 402/73, 75, 76, 402/77, 79, 80 R; 24/67 R, 67.3, 67.11; D19/75, 78, 86, 91; 281/33, 15.1, 36, 37, 38, 40

(56) References Cited

U.S. PATENT DOCUMENTS

| | | | | |
|---|---|---|---|---|
| 102,237 | A | 4/1870 | Emerson | 402/73 |
| 124,961 | A | 3/1872 | Keech | 402/73 |
| 273,301 | A | 3/1883 | Page et al. | 402/73 |
| 369,899 | A | 9/1887 | Willis | 402/73 |
| 521,539 | A | 6/1894 | Greble | 402/73 |
| 579,175 | A | 3/1897 | Parker | 402/73 |
| 659,860 | A | 10/1900 | Schild | 402/73 |
| 776,432 | A | 11/1904 | Shipman | 402/73 |
| 808,347 | A | 12/1905 | Dalton | 402/73 |
| 845,818 | A | 3/1907 | Reuter | 402/73 |
| 957,459 | A | 5/1910 | Duesler | 402/73 |
| 991,753 | A | 5/1911 | Schober | 402/73 |
| 1,163,766 | A | 12/1915 | Morden | 402/80 |
| 1,608,211 | A | 11/1926 | Hermann | 402/80 |
| 1,662,879 | A | 3/1928 | Cederleaf | 402/80 |
| 1,827,592 | A | 10/1931 | Lewis | 402/73 |
| 1,840,916 | A | 1/1932 | Pleasants | 402/73 |
| 1,918,773 | A | 7/1933 | Morehouse | 402/73 |
| 1,979,814 | A | 11/1934 | Unger | 402/73 |
| 2,030,478 | A | 2/1936 | Spinner et al. | 402/73 |
| 2,147,369 | A | 2/1939 | Grumbacher | 402/73 |
| D115,067 | S | 5/1939 | Farkas et al. | 402/73 |
| 2,244,663 | A | 6/1941 | Adams | 402/73 |

(List continued on next page.)

FOREIGN PATENT DOCUMENTS

| | | |
|---|---|---|
| GB | 6047 | of 1909 |

*Primary Examiner*—A. L. Wellington
*Assistant Examiner*—Monica Carter

(57) ABSTRACT

A binder including a binding mechanism having at least one ring member for securing a plurality of pages within the binder; at least one spine member pivotally connected to the binding mechanism; and at least one cover pivotally connected to the at least one spine member. A pin may be provided to secure the at least one ring member to the binding mechanism. The binder may also include a sleeve mounted on the cover for maintaining the at least one cover and the at least one spine member in a fixed position in a single plane. Where two spine members and two covers are used, the two spine members and two covers are advantageously in close parallel relation when in a fully opened position and hide the binding mechanism when fully closed.

13 Claims, 10 Drawing Sheets

U.S. PATENT DOCUMENTS

| | | | | | |
|---|---|---|---|---|---|
| 2,285,234 | A | | 6/1942 | Tauber | 402/73 |
| 2,638,902 | A | | 5/1953 | Emmer | 402/73 |
| 2,715,906 | A | | 8/1955 | Lucchesi | 402/73 |
| 2,718,229 | A | | 9/1955 | Gregory | D19/27 |
| 2,957,477 | A | | 10/1960 | MacLean | D19/27 |
| 3,002,768 | A | | 10/1961 | Ayers et al. | D19/26 |
| 3,003,502 | A | | 10/1961 | Zalkind | D19/27 |
| 3,083,714 | A | | 4/1963 | Foster | D19/27 |
| 3,091,482 | A | | 5/1963 | Cirigliano | D19/27 |
| 3,101,719 | A | | 8/1963 | Vernon | D19/27 |
| 3,135,531 | A | | 6/1964 | Rankin | D19/27 |
| 3,189,369 | A | | 6/1965 | Walker | D19/26 |
| 3,212,505 | A | | 10/1965 | Toman | D19/26 |
| 3,246,652 | A | | 4/1966 | Lang | D19/27 |
| 3,289,675 | A | | 12/1966 | Saunders | D19/27 |
| 3,306,301 | A | | 2/1967 | Mason | D19/27 |
| 3,313,303 | A | | 4/1967 | Beyer | D19/27 |
| 3,313,304 | A | | 4/1967 | Beyer | D19/27 |
| 3,315,682 | A | | 4/1967 | Bachman | D19/27 |
| 3,349,774 | A | | 10/1967 | Ryan | D19/27 |
| 3,351,065 | A | | 11/1967 | Roush | D19/27 |
| 3,373,748 | A | | 3/1968 | MacCormack | D19/27 |
| 3,638,967 | A | * | 2/1972 | Mullins | 281/29 |
| 3,971,572 | A | | 7/1976 | Fenkel | D19/27 |
| 4,114,240 | A | * | 9/1978 | Nakenson | 24/67.11 |
| 4,281,940 | A | | 8/1981 | Rhee | 402/73 |
| 4,934,738 | A | | 6/1990 | Colonna | 402/73 |
| 5,018,896 | A | | 5/1991 | Vanni | 402/73 |
| 5,158,387 | A | | 10/1992 | Davies | 402/73 |
| 5,222,825 | A | | 6/1993 | Wyant | 402/73 |
| 5,338,125 | A | * | 8/1994 | Forsse et al. | 402/46 |
| 5,394,913 | A | * | 3/1995 | Zezza, Jr. et al. | 150/146 |
| 5,417,510 | A | | 5/1995 | Stout | 402/73 |
| 5,607,246 | A | | 3/1997 | Podosek | 402/73 |
| 5,755,513 | A | | 5/1998 | To | 402/73 |

* cited by examiner

FIG. 1a
PRIOR ART
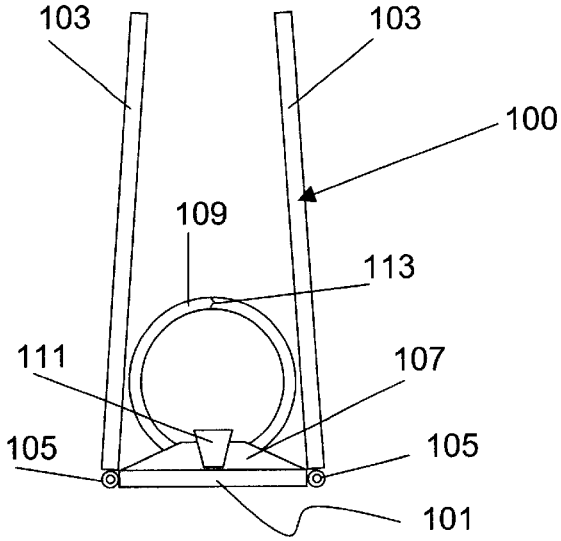
FIG. 1b
PRIOR ART
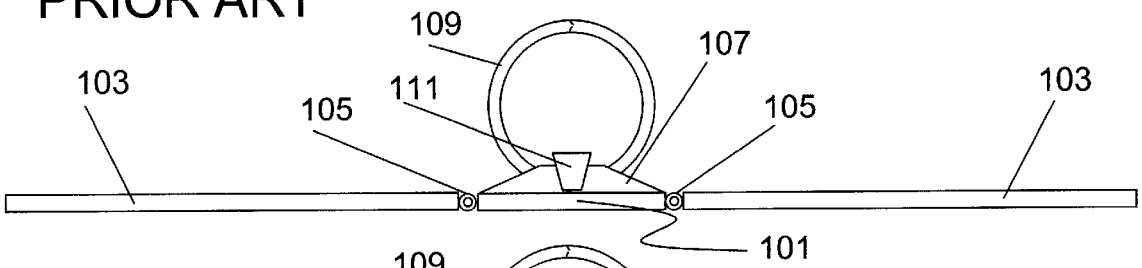
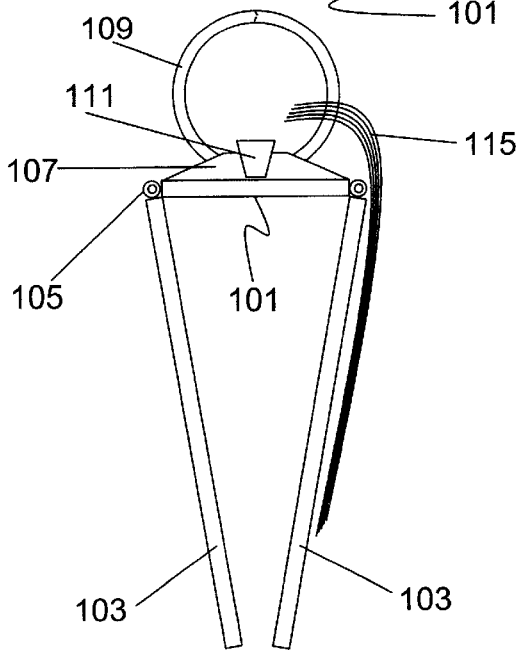
FIG. 1c
PRIOR ART FIG. 2a
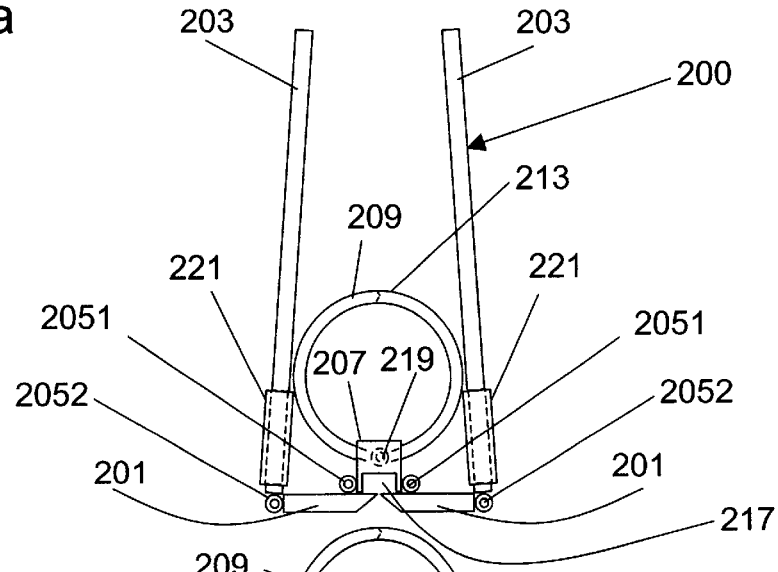
FIG. 2b
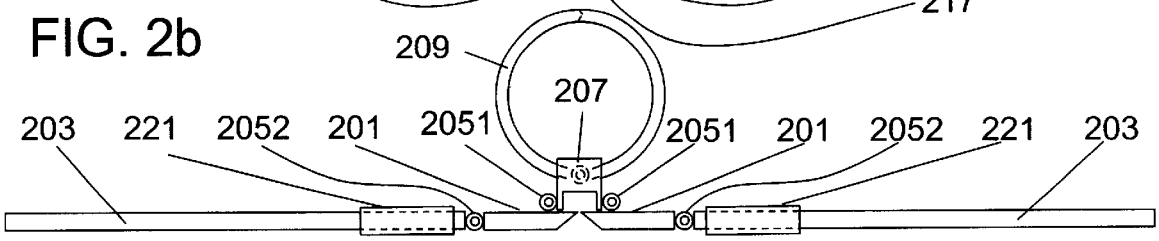
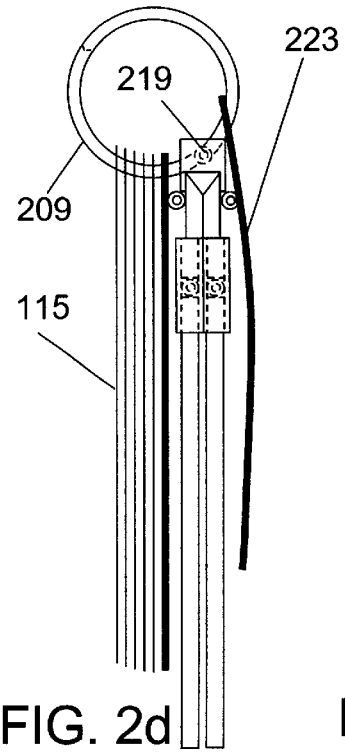
FIG. 2d
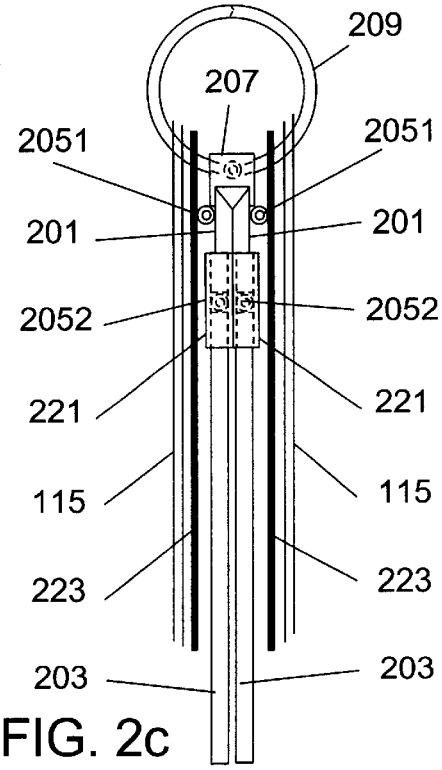
FIG. 2c
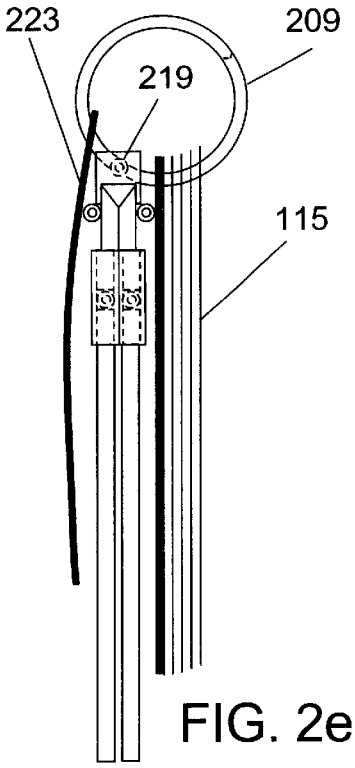
FIG. 2e FIG. 3a
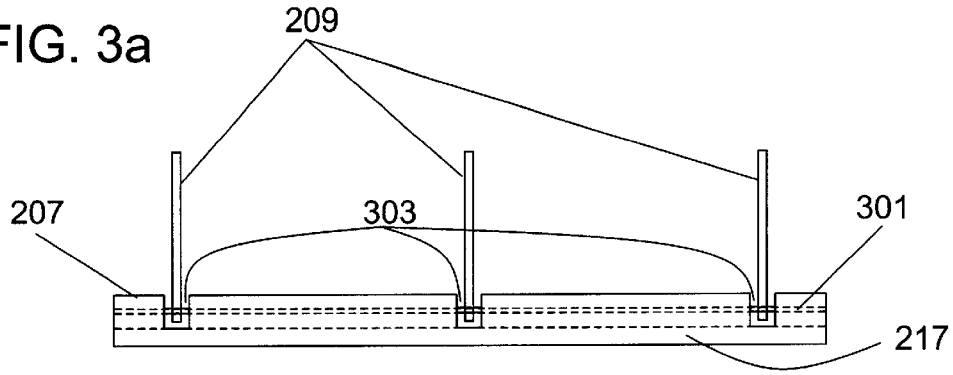
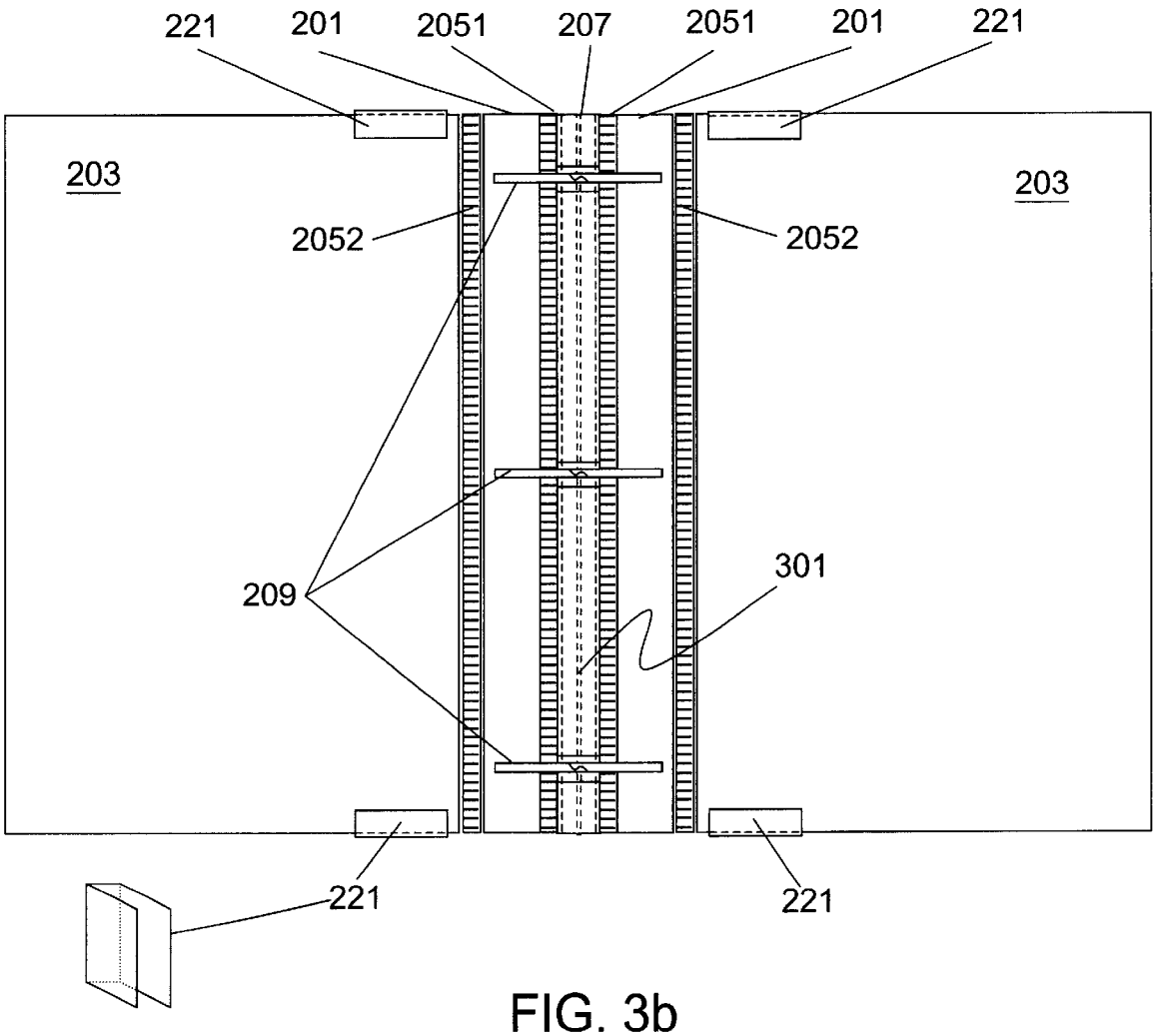
FIG. 3b FIG. 5a
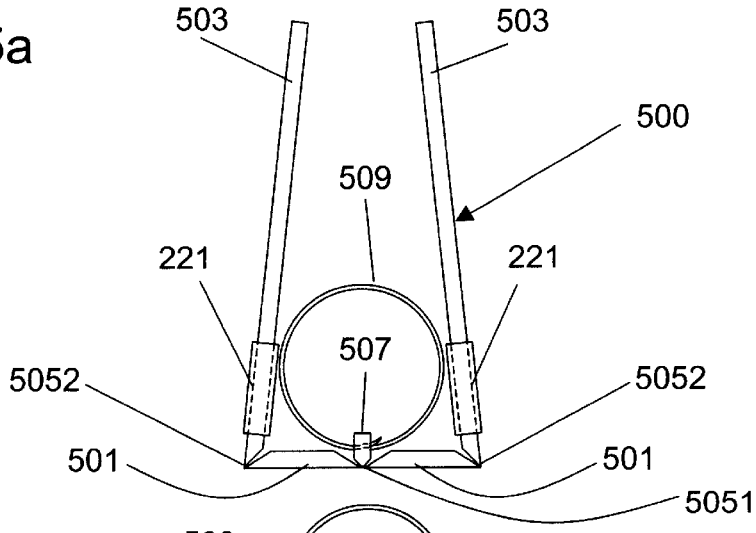
FIG. 5b
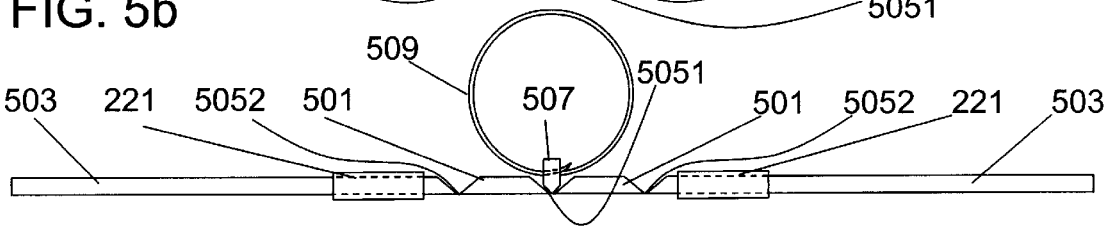
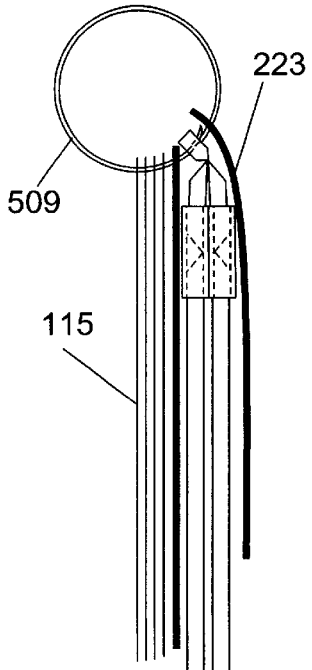
FIG. 5d
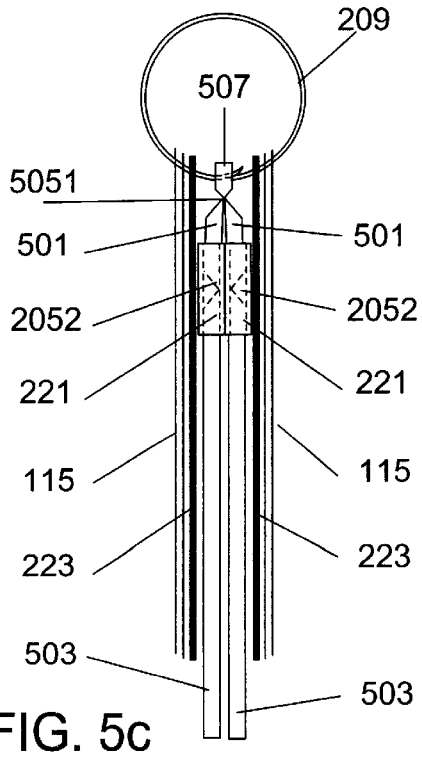
FIG. 5c
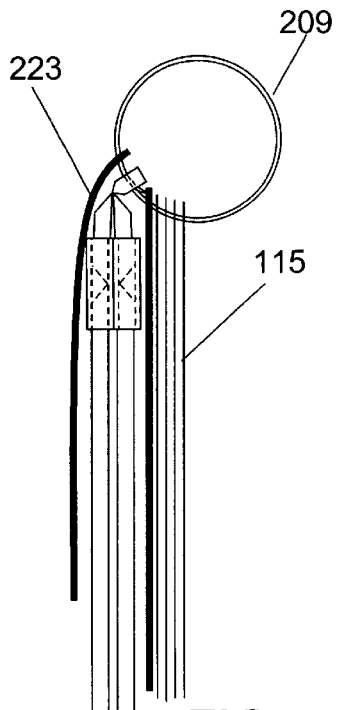
FIG. 5e FIG. 6a
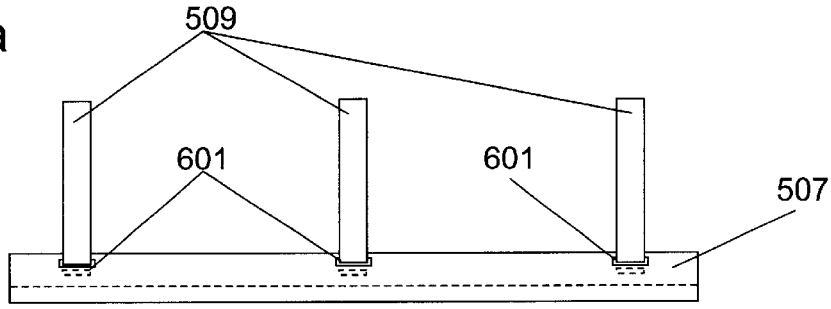
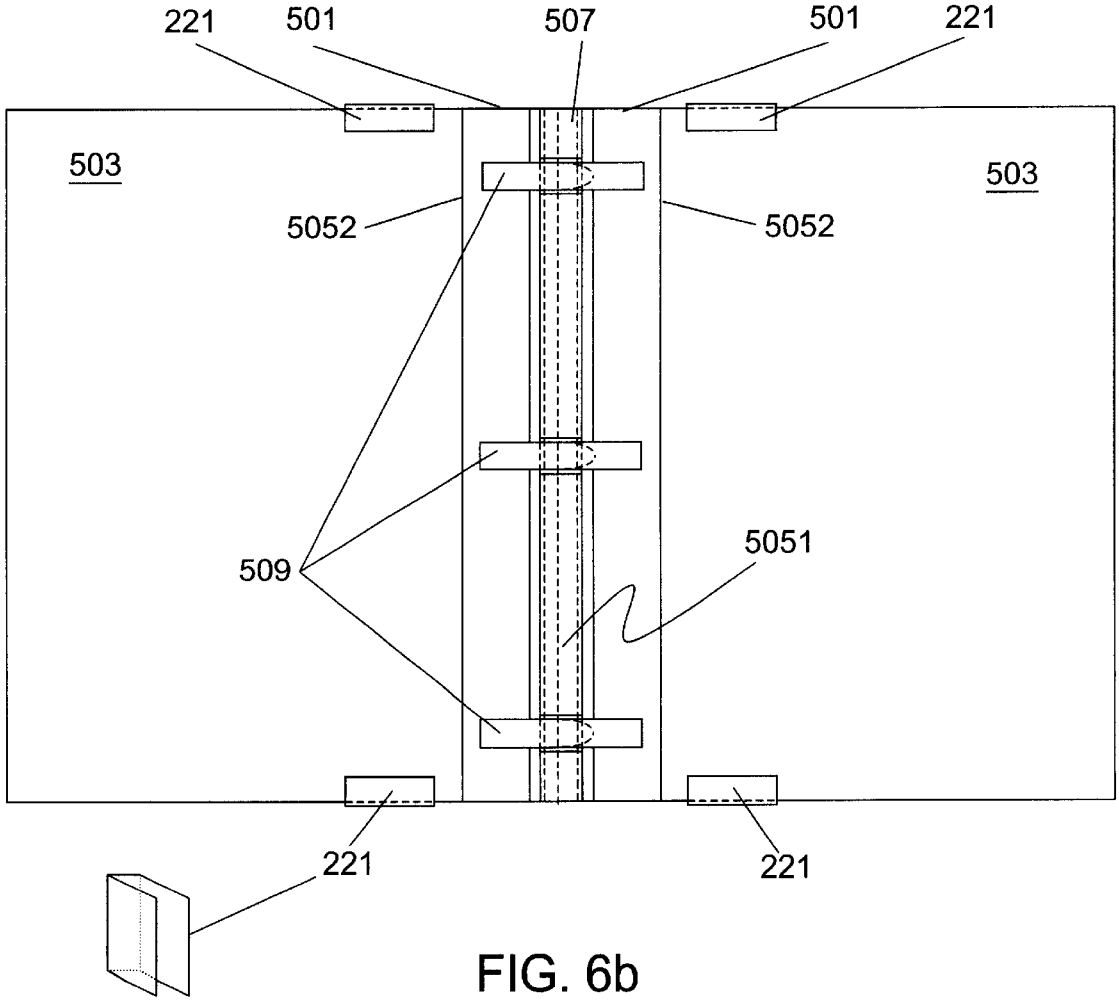
FIG. 6b FIG. 9a
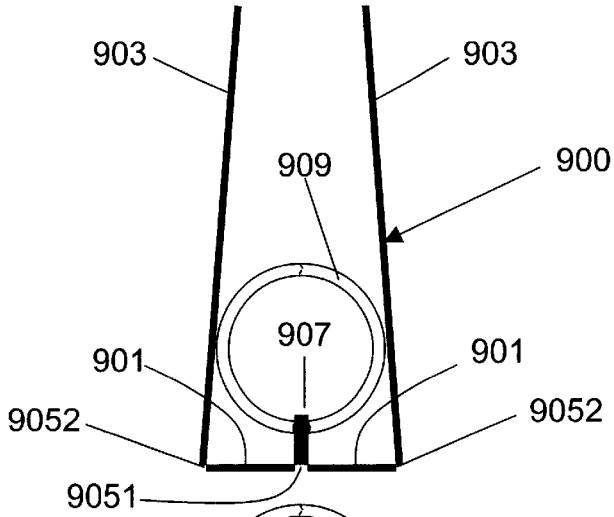
FIG. 9b
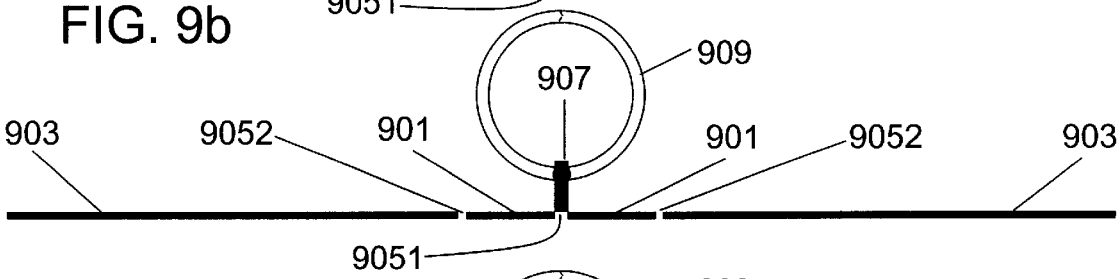
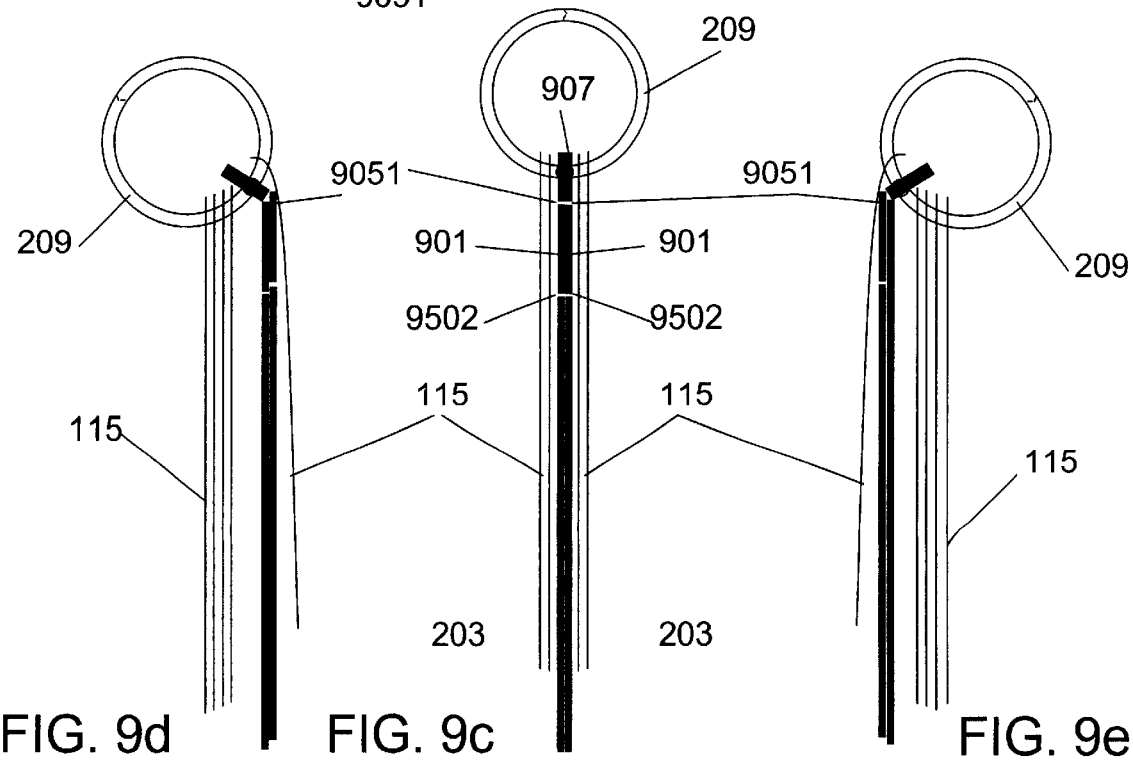
FIG. 9d FIG. 9c FIG. 9e

UNIVERSAL FLEXIBLE BINDER

This application claims priority from provisional application Ser. No. 60/142,468, filed Jul. 6, 1999.

BACKGROUND

1. Technical Field

This invention relates to a unique binder for both releasable and permanently bound documents.

2. Background of the Related Art

Today, huge amounts of printed and handwritten information is stored on flexible sheets while thin objects and collections of sheets are stored in pockets manufactured onto these sheets. All sheets are herein below referred to as pages. Many of these pages are organized sequentially into documents. Many documents held in a binding mechanism are mounted between two rigid or semi-rigid panels herein below referred to also as front and back covers. When referred to together the front and back covers are referred to as covers. Furthermore, documents are bound releasably or non-releasably releasably to a rigid or semi-rigid spine that the two above covers are flexibly attached such that they may freely rotate around the spine. The entire set of three panels along with the above binding mechanism are herein below referred to as a binder.

Classically, a binder takes the form of a hardback or soft back book, spiral notebook, ringed notebook, and a host of other permanent or releasable binder systems. In all cases, the flexible joint between the spine and the two covers allows each cover to be independently rotated so that both covers of the binder lie flat on a planar surface allowing opposing sides of each pair of pages to be viewed simultaneously for reading and/or marking.

A review of prior art reveals a rich history behind today's binding systems. Much attention has been paid to optimizing various binding mechanisms to increase their functionality within the strict limits of a rigid or semi-rigid spine. Prior art patents extend back into the 1800's—for example Emerson's (U.S. Pat. No. 102,237) Temporary Binder. Schild (U.S. Pat. No. 659,860) introduced a more flexible binder system but required that the rings be placed on the outside of the cover which requires an open back. Pain et al. (Foreign Pat. No. 6047) also provided the same type of flexibility and again, placed the rings on the outside of the binder without the means to keep them aligned. Grumbacher (U.S. Pat. No. 2,147,369) introduced a spiral binder for permanently bound documents. Emmer (U.S. Pat. No. 2,638,902) proposed a flexible flat ring model with continuous rigid spine as part of the ring system. Gregory (U.S. Pat. No. 2,718,229) provided a flexible tubular binder without rings. Nackenson (U.S. Pat. No. 4,114,240) utilized a round back spring binder that provided an unusual means of adding and removing pages to a bound document. Prior art of this type extends up to the present and is extensive.

These and other prior art reviewed fail to allow a plurality of important features to be present together in one design. These consist of a larger degree as rotation of the covers such that the outside surfaces of each cover lies flat on top of the other cover in the presence of a spine. They fail to allow for a plurality of binding rings that may be rotated around the long axis of the binder thereby allowing each page to be rotated on the plurality of binding rings such that each page may lie flat on the inside surface of either cover or on top of another page. And, they fail to allow a plurality of pages to be easily added or removed from the binder without requiring that part or all of a document be removed first.

For example, as presently designed, spiral binding systems only allow a limited capacity to more fully rotate pages of very thin documents and do not allow for the easy removal or addition of a plurality of pages anywhere in the document without requiring that some or all of the pages in the binder be removed first.

Furthermore, standard multiple ring binders allow for easy removal or addition of a plurality of pages anywhere in the document but do not allow the covers to rotate such that the outside surface of each cover lies flat on the outside surface of the other cover and do not allow the ring binder to rotate independently of the covers.

Furthermore, the prior art does not allow for the individual pages to be rotated such that they lie flat on the inside surface of either cover or on top of another page when the binder is opened beyond 180 degrees.

Furthermore, the rings in the prior art are rigidly attached to the spine thereby interfering with a right handed person writing on pages rotated to the left of the rings and a left handed person writing on the pages rotated to the right of the rings.

Furthermore, the prior art binders require twice the surface area on a desk or table when fully open for use than when closed.

Furthermore, it is very difficult to open, view, rotate, and mark on pages of the prior art when the prior art binder is held open in the hands and not placed on a flat stable surface.

Each of these features and many others not discussed above are key requirements for developing a useful binder that provides the user with a convenient means of adding, removing, viewing, and marking on a plurality of pages placed in a binder.

For the foregoing reasons, there is a need for an improved binder that allows for the creation of both permanent and releasably bound documents that take up less space when opened, do not interfere with writing on each side of the pages, and can be easily carried and used when open.

SUMMARY OF THE INVENTION

Accordingly, it is an object of this invention to provide a releasable binding system with the flexibility to open to virtually any degree beyond that provided by prior art binding systems while allowing the presence of a spine.

A further object of this invention is to provide for the bound pages therein to be laid flat for viewing and/or marking on either side.

A further object of this invention is to provide for the folding of one cover back onto the other cover while still allowing the bound pages therein to be laid flat for viewing and/or marking.

A still further object of this invention is to provide a pivoting binding system that allows the pages to lie flat on top of the inside surface of either cover or on top of another page when the binder is fully opened.

A still further object of this invention is to provide a binding system allowing the binder to take up far less space than the prior art binders when fully opened and placed on a flat surface.

A still further object of this invention is to provide a binding system allowing for the addition or removal of a plurality of pages without requiring that all or a part of the pages already bound be removed first.

A still further object of this invention is to provide a binding system allowing for the marking of either surface of the bound pages without obstruction from the binding rings.

A still further object of this invention is to provide a binding system allowing for the holding of a fully opened flexible binder in one hand allowing for a stable platform such that the other hand may be used to rotate and mark the bound pages.

A still further object of this invention is to provide a binding system allowing for retrofitting with a removable panel such that the resulting binder looks and functions like prior art binders when required.

BRIEF DESCRIPTION OF THE DRAWINGS

Various other objects, features, and attendant advantages of the present invention will be more fully appreciated as the same becomes better understood when considered in conjunction with the accompanying drawings.

FIG. 1*a* is an orthographic view of a standard three ring binder in a closed position in accordance with the prior art;

FIG. 1*b* is an orthographic view of a standard three ring binder in an opened flat position in accordance with the prior art;

FIG. 1*c* is an orthographic view of a standard three ring binder in a fully opened position with the open ends of each cover closely opposed to each other with exemplary pages rotated to show that they will not lie flat;

FIG. 2*a* is an orthographic view of a first embodiment of the present invention in a closed position;

FIG. 2*b* is an orthographic view of the binder illustrated in FIG. 2*a* in the fully opened position;

FIG. 2*c* is an orthographic view of the binder illustrated in FIG. 2*a* in the fully open position;

FIG. 2*d* is an orthographic view of the binder illustrated in FIG. 2*a* in the fully open position;

FIG. 2*e* is an orthographic view of the binder illustrated in FIG. 2*a* in the fully open position;

FIG. 3*a* is a cross-sectional side view of the binder illustrated in FIG. 2 in accordance with the present invention;

FIG. 3*b* is a top view of the binder of FIG. 2 in accordance with the present invention;

FIG. 5*a* is an orthographic view of another embodiment of the present invention in a closed position;

FIG. 5*b* is an orthographic view of the binder illustrated in FIG. 5*a* in the fully opened position;

FIG. 5*c* is an orthographic view of the binder illustrated in FIG. 5*a* in the fully open position;

FIG. 5*d* is an orthographic view of the binder illustrated in FIG. 5*a* in the fully open position, FIG. 5*e* is an orthographic view of the binder illustrated in FIG. 5*a* in the fully open position;

FIG. 6*a* is a cross-sectional side view of the binder illustrated in FIG. 5 in accordance with the present invention;

FIG. 6*b* is a top view of the binder of FIG. 5 in accordance with the present invention.

FIG. 9*a* is an orthographic view of yet another embodiment of the present invention in a closed position;

FIG. 9*b* is an orthographic view of the binder illustrated in FIG. 9*a* in the fully opened position;

FIG. 9*c* is an orthographic view of the binder illustrated in FIG. 9*a* in the fully open position, FIG. 9*d* is an orthographic view of the binder illustrated in FIG. 9*a* in the fully open position;

FIG. 9*e* is an orthographic view of the binder illustrated in FIG. 9*a* in the fully open position;

DETAILED DESCRIPTION OF PREFERRED EMBODIMENTS

Figure 4A:
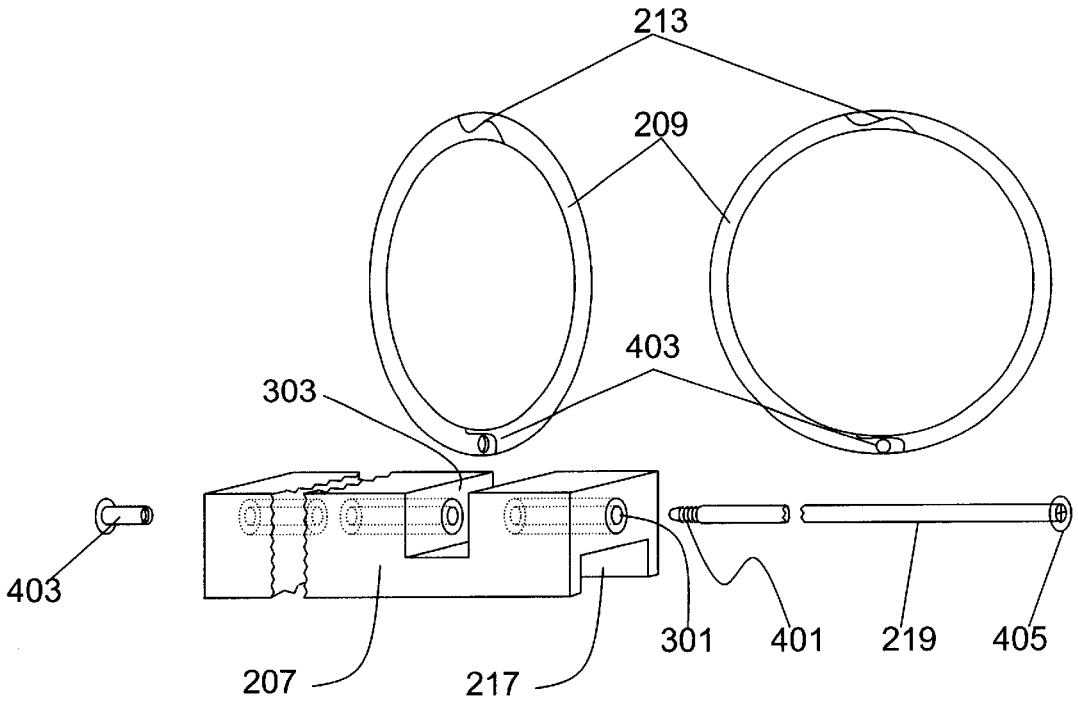
FIG. 4*a* is an exploded view of a binding mechanism in accordance with the present invention.

The significance of the present invention is best understood by presenting an example of the prior art that the present invention proposes to replace.

Shown in FIG. 1*a* is an orthographic view of a prior art binder (100) in the closed position. The binder consists of a flat spine (101), with front and back covers (103), each constructed of rigid or semi-rigid materials. Each cover (103) is bound along one edge to one edge of the spine (101) by a hinge (105) that allows each cover (103) to rotate around the spine (101). Attached to the internal surface of the spine (101) is a releasable binding mechanism (107) with a plurality of attached rings (109) and a key release (111). When the key release (111) is pressed, the plurality of rings (109) open to allow a plurality of hole punched pages (115) to be positioned on the rings (109) and, when the rings are closed, the pages are bound in the binder (100) (pages not shown for clarity). When closed, the rings (109) are prevented from slipping across each other by complementary beveled surfaces (113).

Shown in FIG. 1*b* is an orthographic view of prior art binder (100) in an open position lying flat. In this position the spine (101) and each cover (103) is rotated around each hinge (105) to form a flat surface. This position allows pages (115) (not shown for clarity) to be easily rotated around the rings (109) to lie flat for viewing and/or marking of either side as well as for ease of opening the rings (109) to allow for addition or removal of a plurality of pages.

Shown in FIG. 1*c* is an orthographic view of prior art binder (100) in an open position with each cover (103) rotated about the spine (101) until the open edge of each cover (103) is closely opposed to the other. In this view a set of flexible pages (115) is shown positioned on the rings (109) and flexed back across the releasable binder (107) and hinges (105) in an attempt to get them to lie flat.

Limitation of prior art binders (100): When opened as in FIG. 1*b* to provide a flat surface for pages (115), prior art binders (100) take up more than twice the surface area than when closed as in FIG. 1*a*. As shown in FIG. 1*c* the spine (101) is rigid and prevents each cover (103) from being rotated fully around the hinges (105) to allow the outside surfaces of each cover (103) to lie flat on top of the outside surface of the other cover (103). In those prior art binders that may allow a greater rotation, the covers (103) lie flat with the spine (101) and rings (109) oriented in only one plane preventing the pages (115) from being rotated to the other side without causing excessive bending and folding preventing the user from reading and marking on a surface. In addition, even if the spine (101) is made very narrow, the binding mechanism (107) adds an additional obstruction to rotating pages (115) around the rings (109) preventing pages (115) from lying flat on top of the inside surface of either cover (103) or on top of another page (115) for viewing and/or marking. To make a prior art binding mechanism (107) less obstructive the number of pages that may be bound is greatly limited.

The above stated limitation creates the following serious problems with prior art binders (100):

1. It is not possible to rotate prior art covers (103) to prevent the binder (100) from occupying at least twice the surface area when opened than when closed.
2. It is not possible to closely oppose prior art covers (103) to allow them to lie flat on top of each other and to allow a plurality of pages (115) to lie flat on one or both covers (115).
3. When the prior art binder (100) is opened flat on a surface the rings (109) may obstruct the hand and wrist when a person attempts to mark on a page (115). In particular, the rings (109) obstruct a right handed person trying to mark on pages (115) lying to the left of the rings (109) and the rings (109) obstruct a left handed person trying to mark on pages (115) lying to the right of the rings (109).
4. It is extremely difficult to carry the prior art binder (100) in the hands, open the prior art binder (100) to view and/or mark on pages (115) without hinges (105) allowing one or the both of the covers (103) to rotate freely about the spine (101) creating an unstable working surface.

In a plurality of embodiments of the present invention a unique, universal flexible binder (herein referred to as binder) is described which solves each of the above problems by eliminating the limitations of the prior art.

For example, shown in FIG. 2*a* is an orthographic view of an embodiment of the present invention in the closed position (200) consisting of two identical spines (201) constructed of rigid or semi-rigid materials. Each spine (201) is connected along one edge to a binding mechanism (207) by a first and second hinge (2051). The binding mechanism (207) has a rectangular inset (217). The edge of each spine (201) is beveled opposite each hinge (2051). The opposite edge of each spine (201) is connected to one edge of each cover (203) by a third and fourth hinge (2052). A plurality of tubular rings (209) (herein below referred to as rings) are connected either rigidly or movably to the binding mechanism (207) by a movable central pin (219). The rings (209) can be opened to allow a plurality of pages (115) to be placed in the binder (200) (pages not shown for clarity). When closed, the rings (209) are prevented from slipping across each other by complementary beveled surfaces (113). Each cover (203) has a sleeve (221) that can be moved back and forth over each third and fourth hinge (2052) when the binder (200) is opened to lie flat.

Shown in FIG. 2*b* is an orthographic view of an embodiment of the present invention in an open position lying flat. In this position each spine (201) and each cover (203) is rotated around each third and fourth hinge (2052) to form a flat surface allowing pages (115) (not shown for clarity) to be easily rotated around the rings (209) so that each side of each page (115) may be made to lie flat for viewing and/or marking as well as to allow the rings (209) to be opened to allow for the addition or removal of a plurality of pages (115) without requiring that any other pages (115) be removed first.

Shown in FIG. 2*c* is an orthographic view of an embodiment of the present invention in an open position with each spine (201) rotated about the releasable binding mechanism (207) by the first and second hinges (2051) such that the outside surface of each spine (201) and each cover (203) are closely opposed. In this view, the beveled edge allows each spine (201) to be rotated past each other and into the rectangular inset (217) of the binding mechanism (207) thereby locking each spine (201) and preventing unwanted rotation about each first and second hinge (2051) unless adequate pressure is applied to release each beveled edge from the rectangular inset (217). Each sleeve (221) is positioned over each third and fourth hinge (2052) such that each connected pair of cover (203) and spine (201) are held firmly in a single plane of orientation. In this view a plurality of pages (115) are shown positioned on the rings (209) lying flat on both sides of the binder (200). To prevent damage to pages (115) a plurality of panels (223) may be constructed from a semi-rigid material and interposed between the pages (115) and each paired spine (201) and cover (203).

Shown in FIG. 2*d* is an orthographic view of an embodiment of the present invention in an open position with each spine (201) rotated about the binding mechanism (207) such that the outside surface of each pair of connected spine (201) and cover (203) are closely opposed, and the rings (209) are rotated to the left around the ring pin (219). In this position, all or the majority of pages (115) may be rotated around the rings (209) to lie flat on one side of the binder (200).

Shown in FIG. 2*e* is an orthographic view of an embodiment of the present invention in an open position with each spine (201) rotated about the binding mechanism (207) such that the outside surface of each pair of connected spine (201) and cover (203) are closely opposed, and the rings (209) are rotated to the right around the ring pin (219). In this position, all or the majority of pages (115) may be rotated around the rings (209) to lie flat on one side of the binder (200).

Shown in FIG. 3*a* is a breakout orthographic view of the binding mechanism (207) perpendicular to its long axis as incorporated into an embodiment of the present invention. The binding mechanism (207) is shown with three rings (209) equally spaced to conform to the standard three ring binder (100) of said prior art. Each ring (209) is attached to the ring pin (219) (shown in detail in FIG. 4 below) constructed of metal or another rigid material that runs parallel to the long axis of the binding mechanism within a corresponding cylindrical channel (301). A plurality of rectangular insets (303) are constructed perpendicular to the long axis of the binding mechanism (207) to accommodate the rotation of the rings (209) around the ring pin (219). A person having ordinary skill in the art will see that the number of rings can be increased or decreased and the spacing therebetween may be changed to provide compatibility with other prior art binding systems.

Shown in FIG. 3*b* is an orthographic view of another embodiment of the present invention looking down on the opened binder. Each sleeve (221) is shown as a small, three dimensional C-shaped piece. A person having ordinary skill in the art will see that the sleeve (221) may be slidably or removably secured onto the edge of the cover (203) by a number of different mechanisms including but not limited to tension, spring loaded clip, and key and grove system (not shown for clarity). In addition, a person having ordinary skill in the art will see that the set of sleeves (221) positioned opposite of each other may be constructed as a single larger sleeve that each cover (203) is slipped into to achieve the same effect.

Shown in FIG. 4*a* is a partial, breakout three dimensional view of the binding mechanism (207) incorporated into an embodiment of the present invention. FIG. 4*a* shows ring insets (303) and spine inset (217) with the centrally located ring pin channel (301). The ring pin (219) is constructed with a threaded end (401) that screws into a complementary threaded bolt (403). The ring pin (219) is threaded through the ring pin channel (301) and a ring pin hole (403) manufactured in the ring (209) hinge such that each ring (219) is secured into each ring inset (303). A flat head (405) is located on both threaded bolt (403) and ring pin (219) with one or a plurality of depressions to allow for the use of a tool such as a screw driver or Alan key to tighten and secure or loosen and remove the ring pin (219) from the ring pin channel (301).

Figure 4B:
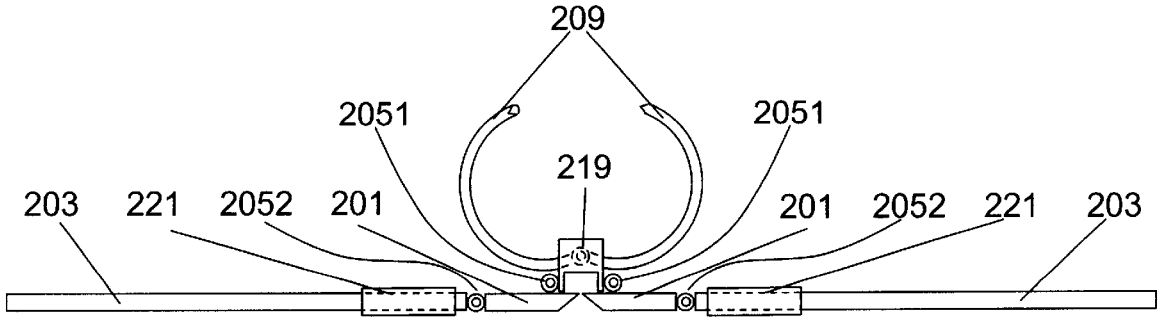
FIG. 4*b* is a side view of a binder in accordance with the present invention.

Shown in FIG. 4*b* is an orthographic view of an embodiment of the present invention in an open position lying flat. In this position the rings (209) are shown opened by rotation on the ring pin (219) to allow for the addition or removal of a plurality of pages (115).

Shown in FIG. 5*a* is an orthographic view of an embodiment of the present invention in the closed position (500). This embodiment consists of two identical, spines (501) each constructed of rigid or semi-rigid materials connected along one edge to a releasable binding mechanism (507) (herein below referred to as a binding stub) by a first flexible joint (5051) (referred to hereinbelow as a hinge), manufactured from plastic, rubber, cloth, tape or other flexible yet resilient material. The spines (501) have one flat surface beveled at the edges connected to the binding stub (507). The binding stub has one edge beveled on both sides of the edge connected to the spines (501). The opposite edge of each spine (501) is connected to one edge of each cover (503) by a second and third flexible joint (2052). Each spine (501) has one flat surface beveled at the edge connected to each cover (503). Each cover (503) is beveled at the edge connected to each spine (501). A plurality of flat rings (509) (referred to herein as rings) are connected to the binding stub (507) by a flexible junction (701) (see FIG. 7 for further details.) Each ring (509) is manufactured from a flexible material that retains a predefined curvilinear shape when not being manually flexed or bent. Each ring (509) has a free end (705) (see FIG. 7 for details) that can be exposed to allow a plurality of slotted punched pages (not shown for clarity) to be placed in or removed from the binder (500). Each cover (503) has a rigid sleeve (221) that can be moved back and forth over each second and third joint (5052) that connects each cover (503) to each spine (501).

Shown in FIG. 5*b* is an orthographic view of an embodiment of the present invention in an open position lying flat. In this position each spine (501) and each cover (503) is rotated around the second and third joints (2052) to form a flat surface. The position allows pages (115) (not shown for clarity) to be easily rotated around the rings (509) so that each side of each page (115) may be made to lie flat for viewing and/or marking as well as to allow for the addition or removal of a plurality of pages (115).

Shown in FIG. 5*c* is an orthographic view of an embodiment of the present invention in an open position with each spine (501) rotated about the releasable binding mechanism (507) by the first hinge (5051) such that the outside surface of each spine (501) and each cover (503) are closely opposed. Each sleeve (221) is positioned over each second and third hinge (5052) such that each connected pair of the cover (503) and spine (501) are held firmly in a single plane of orientation. A plurality of pages (115) is shown positioned on the rings (209) lying flat on both sides of the binder (500). To prevent damage to the pages (115) a plurality of panels (223) may be constructed from a semi-rigid material and interposed between the pages (115) and each paired spine (501) and cover (503).

Shown in FIG. 5*d* is an orthographic view of an embodiment of the present invention in an open position with each spine (501) rotated about the binding stub (507) such that the outside surface of each pair of connected spine (501) and cover (503) are closely opposed, and the rings (509) with binding stub (507) are rotated to the left around the first hinge (5051). In this position, all or the majority of pages (115) may be rotated around the rings (509) to lie flat on one side of the binder (500).

Shown in FIG. 5*e* is an orthographic view of an embodiment of the present invention in an open position with each spine (501) rotated about the binding stub (507) such that the outside surface of each pair of connected spine (501) and cover (503) are closely opposed, and the rings (509) with binding stub (507) are rotated to the right around the first hinge (5051). In this position, all or the majority of pages (115) may be rotated around the rings (509) to lie flat on one side of the binder (500).

Shown in FIG. 6*a* is a breakout orthographic view of the binding stub (507) perpendicular to its long axis as incorporated into an embodiment of the present invention. The binding stub (507) is shown with three rings (509) equally spaced to conform to the standard three ring binder of prior art. A rectangular slot (601) is constructed to accommodate the free end (705) of the rings (509) as shown herein below in FIGS. 7*a* and *b*. A person having ordinary skill in the art will see that the number of rings can be increased or decreased and the spacing therebetween may be changed to provide compatibility with other prior art binding systems.

Shown in FIG. 6*b* is an orthographic view of an embodiment of the present invention looking down on the opened binder (500). Each sleeve (221) is shown as a small, three dimensional C-shaped piece. A person having ordinary skill in the art will see that the sleeve (221) may be slidably or removably secured onto the edge of the cover (503) by a number of different mechanisms including but not limited to tension, spring loaded clip, and key and grove system (not shown for clarity). In addition, a person having ordinary skill in the art will see that the set of sleeves (221) positioned opposite of each other may be constructed as a single larger sleeve that each cover (503) is slipped into to achieve the same effect.

Figure 7A:
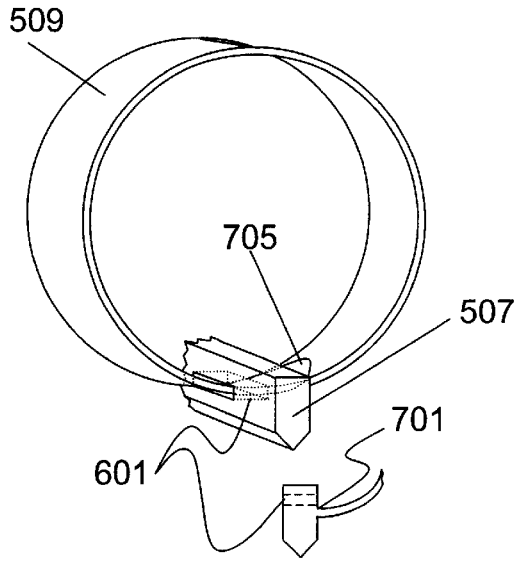
FIG. 7*a* is an exploded view of a binding mechanism in accordance with the present invention.

Shown in FIG. 7*a* is a partial, breakout three dimensional view and breakout orthographic sub-view of the binding stub (507) incorporated into an embodiment of the present invention. The view shows a ring attachment site (701) near the base of the binding stub (507). The opposite end (705) of each ring (509) is free and beveled to allow for ease of insertion into the slot (601). The free end (705) may be held in place by tension. A person having ordinary skill in the art will see that the free end (705) may also be secured and released from the slot (601) by using any number of devices in the public domain including but not limited to depressible buttons, depressible or spring loaded side clips, and various types of snaps.

Figure 7B:
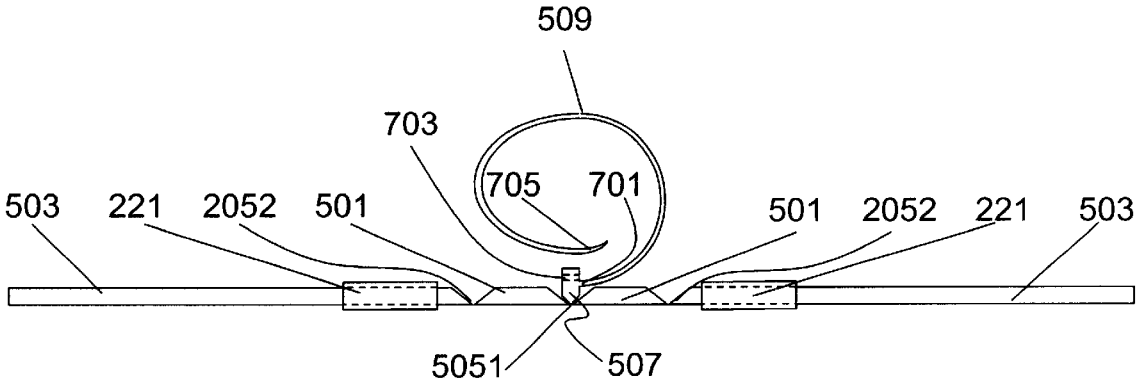
FIG. 7*b* is a side view of a binder in accordance with the present invention.

Shown in FIG. 7*b* is an orthographic view of an embodiment of the present invention in an open position lying flat. In this position the rings (509) are shown opened to allow for the addition or removal of a plurality of pages (115) (not shown for clarity).

Figure 8A:
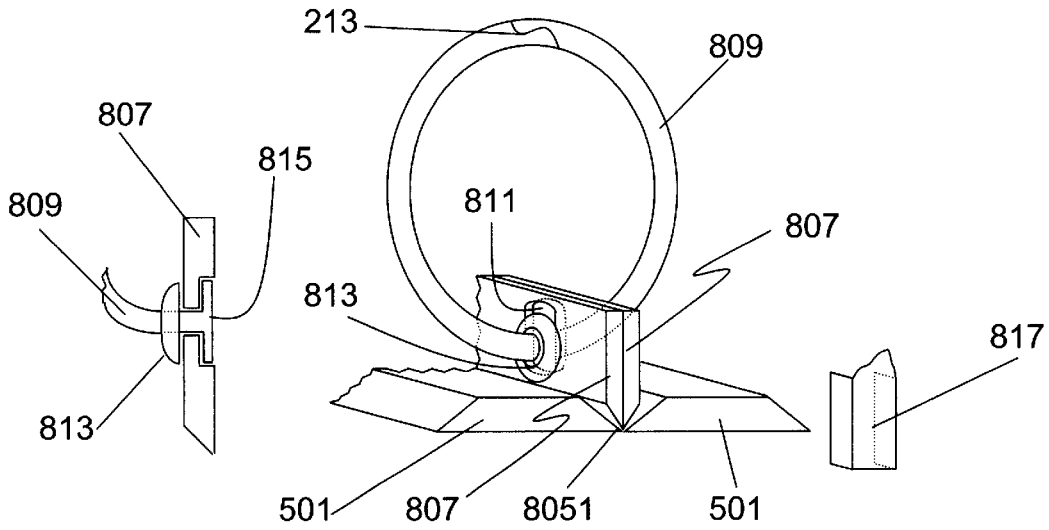
FIG. 8*a* is an orthogonal view of another embodiment of the present invention illustrating an alternate ring binding system.

Shown in FIG. 8*a* is a partial, breakout three dimensional view and orthographic sub-view of another embodiment of the binding stub (507) incorporated into an embodiment of the present invention. The view shows the spines (501) joined to two mirror image binder stubs (807) wherein each binder stub (807) has one beveled surface facing each spine (501). All four surfaces are connected by a flexible joint (8051) also referred to as a hinge herein below, manufactured from plastic, rubber, cloth, tape or other flexible material. A tubular ring (809) manufactured of metal or other rigid material is connected to each binding stub (807) by a key-in-slot mechanism with the top portion of the slot (811) shown just above a retaining ring (813) which is attached to the ring (809). The binding stubs (807) are held together by two clips (817), placed on each free end of the paired and opposed binding stubs (807). A person having ordinary skill in the art will see that the clips (817) may be separate from the binder (500) or connected to each end of the binder (500) by a hinge (not shown for clarity) thereby allowing each clip (817) to be rotated on and off of the binding stubs (807) alternately securing the binding stubs (807) together or letting them fall apart at the hinge (8051). When the binding stubs (807) are secured each half of the ring (809) is closed whereas, when the binding stubs (807) are allowed to fall apart at the hinge (8051) each half of the ring (809) is open to allow for the addition or removal of pages (115). In addition, the binding stubs (807) may be designed such that, when the clips (817) are in place, the rings (809) are kept closed under sufficient pressure to prevent the pages from falling off the rings (809).

A first orthographic sub-view looking down on the key-in-slot mechanism is shown to the left in FIG. 8*a* to illustrate the rectangular slot (811) opening with a ring stop (813) that glides over the outer surface of each binding stub (807). In this sub-view the ring (809) is shown having an end plate (815) which fits into the slot (811) such that it can slide up and down freely and holds each half of the ring (809) securely to the binding stub (807). The retaining ring (813) slides over the ring (809) and by tension, or other means, prevents the end plate (815) from popping out of the slot (811).

Figure 8B:
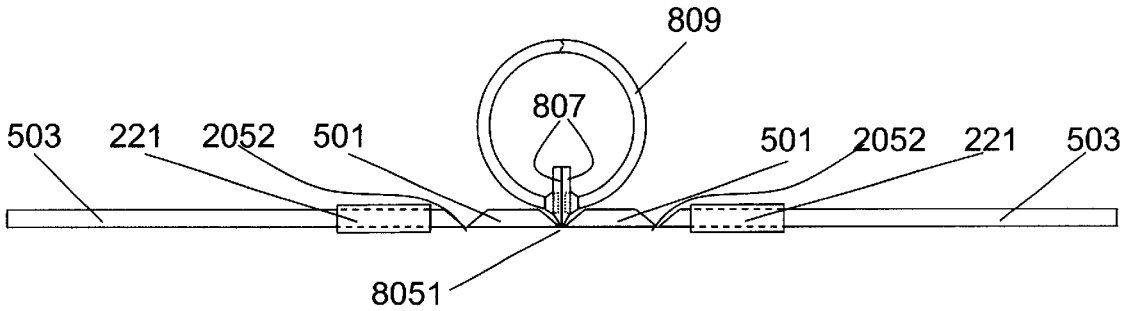
FIG. 8*b* is a side view of a binder in accordance with an embodiment of the present invention illustrating an alternate ring binding system in the closed position.

Shown in FIG. 8*b* is an orthographic view of an embodiment of the present invention in an open position lying flat. In this position the rings (809) are shown closed and the end plate (815) positioned at the bottom of the slot (811) to allow for the rotation of a plurality of pages (115).

Figure 8C:
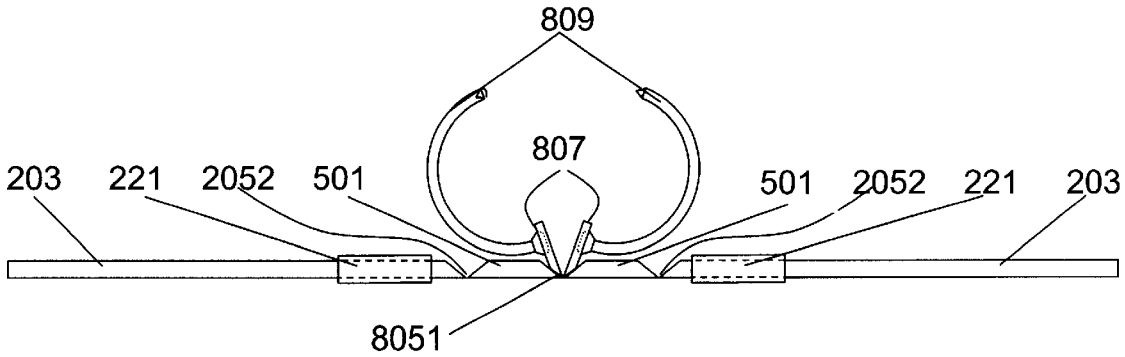
FIG. 8*c* is a side view of a binder in accordance with an embodiment of the present invention illustrating an alternate ring binding system in the open position.

Shown in FIG. 8*c* is an orthographic view of an embodiment of the present invention in an open position lying flat. In this position the rings (809) are shown opened and the end plate (815) positioned at the top of the slot (811) to allow for the addition or removal of a plurality of pages (115).

Shown in FIG. 9*a* is an orthographic view of another embodiment of the present invention in the closed position herein referred to as a binder (900). This embodiment consists of two identical panels (901,903) of a semi-rigid material such as plastic or cardboard scored or otherwise manufactured to create flexible joints (herein below also referred to as hinges). A first hinge (9051) is formed to create the releasable binding stub (907) (herein below referred to also as a binding mechanism). The two identical panels (901,903) are bound together along one flat surface of each binding stub (907). A second and third hinge (9052) are formed to create two spines (901) and two covers (903). A plurality of rings (909), constructed of a rigid or semi rigid material may be attached to the binding stub (907) using a movable ring pin (219) as shown herein above in FIGS. 2–4 sandwiched between the two panels making up the binding stub (907).

Shown in FIG. 9*b* is an orthographic view of an embodiment of the present invention in an open position lying flat. In this position each spine (901) and each cover (903) is rotated around the second and third hinges (9051) to form a flat surface. This position allows pages (115) to be easily rotated around the rings (909) so that pages (115) lie flat for viewing and/or marking of either side of the page (115) as well as for ease of opening the rings (909) to allow for the addition or removal of a plurality of pages (115).

Shown in FIG. 9*c* is an orthographic view an embodiment of the present invention in an open position with each spine (901) rotated about the releasable binding mechanism (907) by the first hinge (9051) such that the outside surface of each spine (901) and each cover (903) are closely opposed. An optional sleeve (221) may be positioned over each second and third hinge (9052) such that each connected pair of cover (903) and spine (901) are held firmly in a single plane of orientation (not shown for clarity). A plurality of pages (115) is shown positioned on the rings (909) lying flat on both sides of the binder (900).

Shown in FIG. 9*d* is an orthographic view of an embodiment of the present invention in an open position with each spine (901) rotated about the binding stub (907) such that the outside surface of each pair of connected spine (901) and cover (903) are closely opposed, and the rings (909) with binding stub (907) are rotated to the left around the first hinge (9051). In this position, all or the majority of the pages (115) may be rotated around the rings (909) to lie flat on one side of the binder (900).

Shown in FIG. 9*e* is an orthographic view of an embodiment of the present invention in an open position with each spine (901) rotated about the binding stub (907) such that the outside surface of each pair of connected spine (901) and cover (503) are closely opposed, and the rings (909) with binding stub (907) are rotated to the right around the first hinge (9051). In this position, all or the majority of the pages (115) may be rotated around the rings (909) to lie flat on one side of the binder (900).

A person having ordinary skill in the art will see that in the present embodiment of the invention, the rings can be dispensed with and the pages (115) bound in the binder by providing one of a plurality of flexible binding mechanisms that provides for placing one edge of each page between the binding stubs (907) and securing the binding stubs together. In this embodiment, the binding stubs (907) when secured together may be rotated around the hinge (9051) such that a large number of pages (115) may be rotated to lie flat on either cover (903).

Figure 10A:
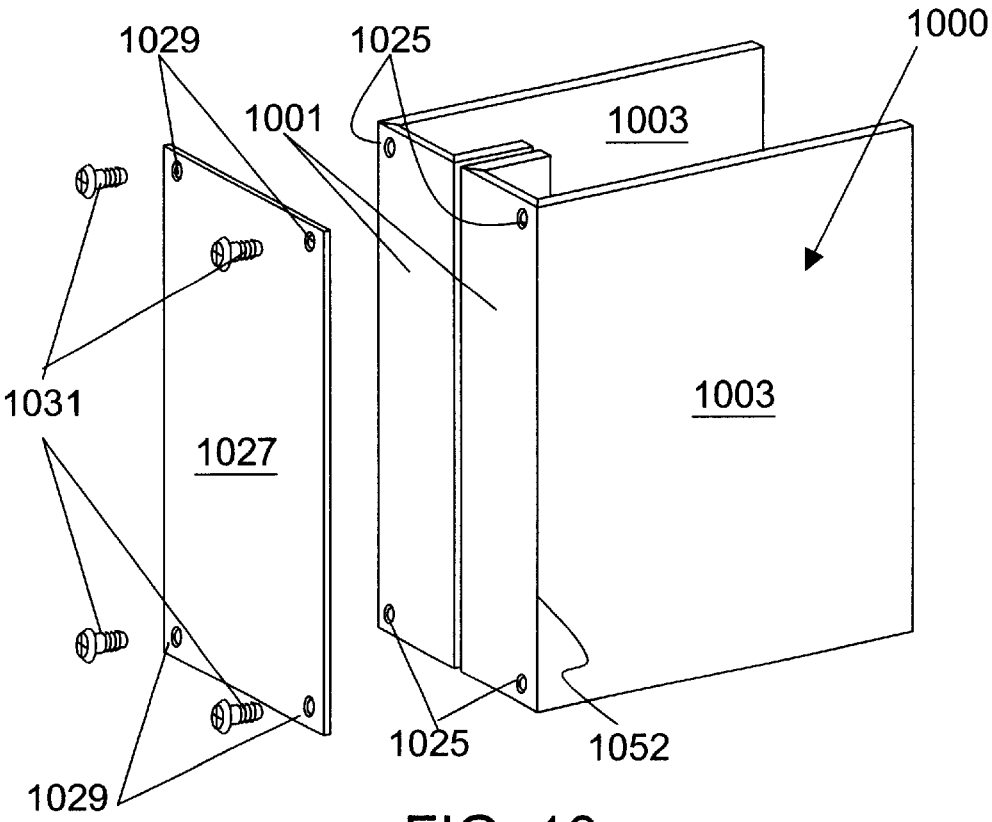
FIG. 10*a* is an orthogonal view of a mechanism to prevent rotation of the spine of a binder in accordance with the present invention.

Shown in FIG. 10*a* is a three dimensional view of a generalized version of the universal flexible binder (1000) as an embodiment of the present invention. Four threaded holes (1025) are manufactured into the external surfaces of two hinged spines (1001). A rigid or semi-rigid panel (1027) herein below referred to as a back panel is manufactured to fit over the two spines (1001). Four unthreaded holes (1029) are manufactured through the back panel (1027) such that four threaded screws (1031) may be passed through unthreaded holes (1029) to attach the back panel (1027) to the two spines (1001) thereby securing them in a flat plane. The hinges (1052) that connect each spine (1001) to each cover (1003) are shown flexed to 90 degrees.

Figure 10B:
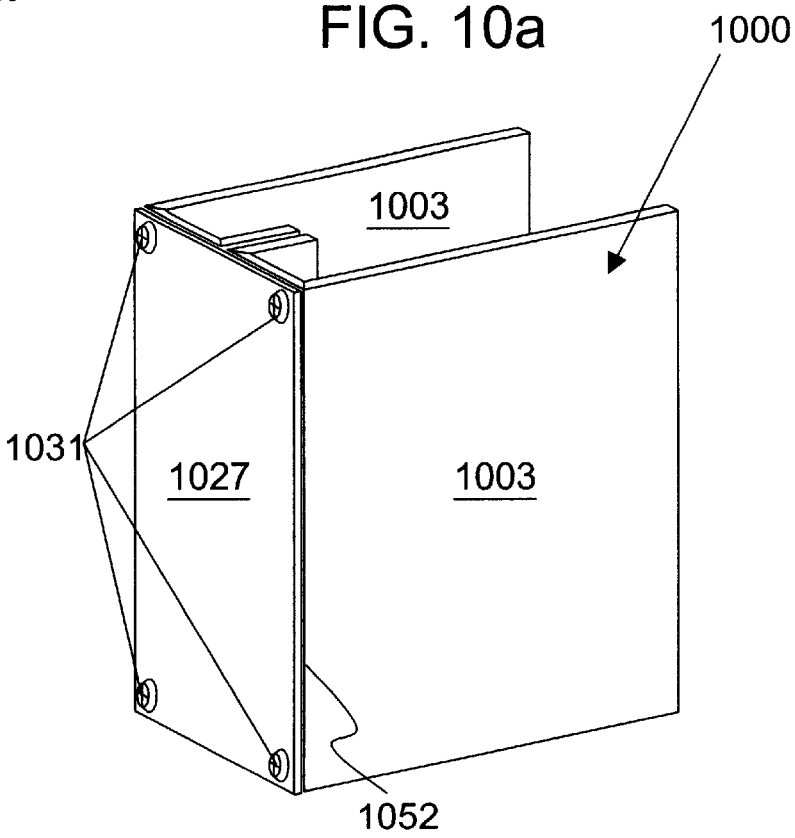
FIG. 10*b* is an orthogonal view of a mechanism to prevent rotation of the spine of a binder in accordance with the present invention.

Shown in FIG. 10*b* is a three dimensional view of a generalized version of the universal binder (1000) as an embodiment of the present invention with the back panel (1027) attached to the two spines (1001) and all sleeves (221) removed so that the binder (1000) can be used as a prior art binder if the user so chooses.

A person having ordinary skill in the art will see that, in the present embodiment of the invention, the back panel (1027) may be attached to the spines (1001) using a variety of snaps and clips presently available on the market, and that the threaded screws (1031) were used as one of a plurality of examples and are not meant to limit the scope of this invention.

In summary, the various binding systems presented herein above provide a new and unique means of creating a flexible and easy to use binder as defined herein above to solve the problems posed by all prior art.

The above preferred embodiments are not meant to limit the scope of the present invention. A person having ordinary skill in the art will see that many other unspecified capabilities may be accessed through minor modifications of the spine, cover hinge, and binding mechanism. For example, instead of using rings, the pages (115) may be bound permanently together using glue and/or cloth. A flexible extension may be added to the bound pages such that it may be inserted into or between the above the binding stubs. Clear plastic slips may be manufactured onto any of the flat surfaces of the covers and/or spines to provide for the insertion of labels. The surface of the covers and/or spines may be manufactured of a material that allows for direct marking on the cover and/or spine surface. Each spine may be manufactured to allow for it to be widened or shortened. The binding system may be manufactured to allow for the rings to be replaced by larger or smaller rings thereby providing a means for increasing or decreasing the total capacity of the binder. In addition, provision may be made to allow for rings to be added to or removed from the binder thereby allowing for a single binder to emulate multiple prior art binders. Furthermore, a person having ordinary skill in the art will see that any of the above embodiments of the binding system may be used with any of the above embodiments of the hinge system to create a binder.

What is claimed is:

1. A binder comprising:

a binding mechanism;

a first spine panel attached to a first edge of said binding mechanism to form a first hinged joint;

a second spine panel attached to a second edge of said binding mechanism to form a second hinged joint such that said first spine panel and said second spine panels may be rotated about said first and second hinged joints, respectively, until a plane formed by said first spine panel and a plane formed by said second spine panel are parallel to each other, at least one first page bound to said binding mechanism, and at least one second page bound to said binding mechanism such that said at least one first page may be rotated substantially 360 degrees about said binding mechanism and said at least one second page may be rotated substantially 360 degrees about said binding mechanism.

2. The binder as recited in claim 1, further comprising:

a first cover attached to said first spine panel along a second edge to form a third hinged joint; and a second cover attached to said second spine panel along a second edge to form a fourth hinged joint such that said first cover may be rotated about said third and fourth hinged joints, respectively, until a plane formed by said first cover and a plane formed by said second cover are parallel to each other.

3. The binder as recited in claim 2, wherein:

said first spine panel may be rotated to lie flat on said second spine panel; and said first cover may be rotated to lie flat on said second cover such that, when said first spine panel and said first cover are simultaneously rotated, the binder lies flat and occupies a surface area on a flat surface equal to the surface area of one of the first and second spine panels and one of the first and second covers.

4. The binder as recited in claim 1, wherein:

said at least one first page may be rotated to lie flat on at least one of said first and said second cover when the first cover is rotated to lie flat on said second cover.

5. The binder as recited in claim 1, wherein:

said at least one second page may be rotated to lie flat on at least one of said first and said second cover when the first cover is rotated to lie flat on said second cover.

6. A binder comprising:

a binding mechanism;

at least one spine member pivotally connected to said binding mechanism;

at least one cover pivotally connected to said at least one spine member; and a sleeve mounted on said cover for maintaining said at least one cover and said at least one spine member in a fixed position in a single plane.

7. The binder as recited in claim 6 wherein said binding mechanism includes at least one ring member for securing a plurality of pages within the binder.

8. The binder as recited in claim 7, wherein said binding mechanism defines a bore along the longitudinal axis thereof for receiving a pin for securing said at least one ring member to said binding mechanism.

9. The binder as recited in claim 6 comprising two spine members pivotally connected to said binding mechanism.

10. The binder as recited in claim 9, further comprising a panel connected to said two spine members for securing said two spine members in a single plane.

11. The binder as recited in claim 6 comprising two spine members pivotally connected to said binding mechanism and two covers pivotally connected to said two spine members.

12. The binder as recited in claim 11, wherein said two spine members and said two covers are in parallel relation in a fully opened position.

13. The binder as recited in claim 11, wherein said two spine members and said two covers are rotated such that said binding mechanism with said at least one ring member are substantially hidden from sight.

* * * * *